United States Patent [19]

Wallstén

[11] 4,358,481

[45] Nov. 9, 1982

[54] METHOD AND APPARATUS FOR COATING BOTH SIDES OF A MOVING WEB

[75] Inventor: Hans I. Wallstén, Lausanne, Switzerland

[73] Assignee: Inventing S.A., Lausanne, Switzerland

[21] Appl. No.: 266,832

[22] Filed: May 26, 1981

[30] Foreign Application Priority Data

Jun. 10, 1980 [SE] Sweden ..... 8004314

[51] Int. Cl.[3] ..... B05D 3/12

[52] U.S. Cl. ..... 427/211; 118/405; 118/407; 118/413; 427/356; 427/361; 427/209

[58] Field of Search ..... 118/407, 409, 416, 419, 118/420, 405, 404, 413; 427/209, 211, 356, 358, 361

[56] References Cited

U.S. PATENT DOCUMENTS 3,489,592 1/1970 Wallsten ..... 427/209
3,899,615 8/1975 Wallsten ..... 427/211
4,076,864 2/1978 Wallsten ..... 427/209
4,288,473 9/1981 Wallsten ..... 427/209

*Primary Examiner*—Michael R. Lusignan
*Attorney, Agent, or Firm*—Brumbaugh, Graves, Donohue & Raymond

[57] ABSTRACT

A method and apparatus for coating both sides of a moving web, such as a paper web, with the same coating material on both sides by feeding the web downwardly between a rotating support roller and a coating blade directed against said roller. One side of the web is partially wrapped around said roller and a first excess of coating material intended for the web side facing said roller is applied to the roller before or at the point of contact between said web and the roller. A second excess of coating material is applied to the other side of the web by feeding the web through a dam of coating material arranged below said contact point—in the moving direction of the web—said dam being formed substantially between said coating blade and holder and the said other side of the web. The excess coating material is laterally expressed in said dam beneath the top level thereof.

10 Claims, 3 Drawing Figures

METHOD AND APPARATUS FOR COATING BOTH SIDES OF A MOVING WEB

Figure 1:
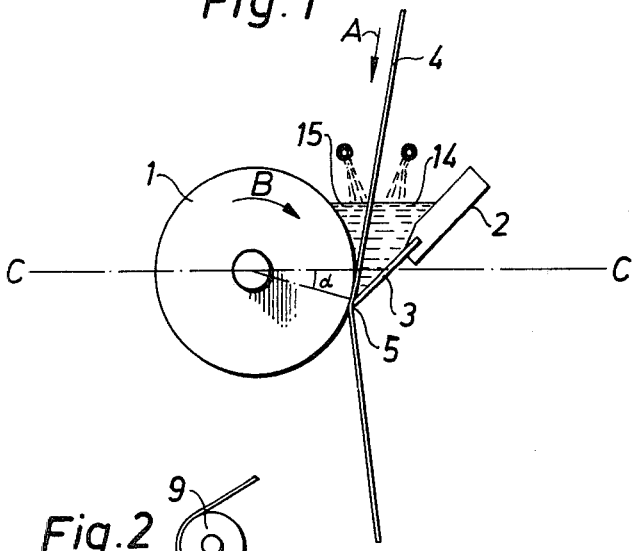

The present invention relates to a method and apparatus for coating both sides of a moving web, such as a paper web, with the same coating material on both sides, whereby the web is running downwardly between a rotating support roller and a coating blade and holder cooperating with said roller.

A simultaneous treatment of both sides of a moving paper web with the same coating material is known for example in a sizing press, whereby the paper web is moved vertically downwards through a press nip formed between two rotating rollers pressing against one another, the coating material is applied to both sides of the paper web so that a dam of appropriate height is formed on either side of the paper web between the web and the roller on the same side.

When coating in accordance with this known method a number of disadvantages occur. In using a starch solution or a pigment dispersion as coating material, an orange-peel effect is obtained in the applied coating layer due to the fact that the paper web and the roller surfaces are separated from one another after said nip at largely the same speed, resulting in a dripping in the applied coating layers where the surfaces are removed from one another. This problem increases with increasing web speed.

Another problem which also increases with increasing web speed is the incidence of considerable turbulence in these dams of coating material. The reason for this is that the boundary surfaces of the dam, i.e. the roller surface and the paper web, have the same direction of movement and thus the coating material is brought into movement downwards towards the nip by the respective surface. At high web speeds this downwardly directed movement becomes very vigorous and results in the flows of coating materials being deflected upwards at great force as a result of a collision when they meet near the bottom of the dam, whereupon the flows reach the surface of the dam. This movement may be so violent that eruptions occur and the coating material is thrown up and out of the dam, thereby limiting the web speed. Thus it has been found that there is a certain top critical speed above which the sizing press cannot be operated. This top speed depends on various factors but is regarded as being between 400 and 600 meters per minute.

In a further known method for simultaneously coating both sides of a paper web with the same coating material the paper web is caused to pass a dam of coating material, when moving in a downward direction, said dam being limited if seen in the direction of movement of the web by a coating blade which presses said paper web against a rotating support roller, so that the coating material in the dam comes into contact with both sides of the web. The advantage of this known method is that it eliminates the above mentioned orange-peel effect.

However, it has been found that this known method—the so called BILLBLADE ® method—in some cases results in a break of the paper web when the web passes the coating station, especially if the paper is extremely thin or is of very low strength. The reason for this is that when the paper web passes into the nip between the supporting roller and the blade it is only supported to a minor degree by the surface of the rotating roller. Another disadvantage with this known method occurs at relatively high web speeds, whereby a considerable movement and agitation arises in the sub-dam formed between the roller and the paper web, just as in the case of the sizing press, and at higher web speeds this can also result in the paper web breaking, particularly when thin or weak papers are being coated. It has also been found that the other sub-dam formed between the blade holder containing the blade and the paper web is much calmer and does not cause any problems, and this may be due to the fact that in this sub-dam there is only one moving side, i e the paper web, while its other boundary, i e the blade and the blade holder, is stationary. A calmer circulation thus occurs in the sub-dam on this side of the web.

It has now surprisingly been found that the above problems and difficulties can be eliminated by the present invention.

According to the present invention, a method for applying a coating to both sides of a web, such as a paper web, is now provided, said method comprising the steps of (a) feeding the web downwardly between a support roller and a coating blade directed against the roller;

(b) arranging one side of the web to partially wrap around the rotating roller and applying a first excess of coating material intended for the side of the web facing the roller to said roller before or at the point of contact between the web and said roller;

(c) applying a second excess of coating material to the other side of the web by passing the web through a dam of coating material situated below said contact point—if seen in the direction of movement of the web—said dam being formed substantially between the coating blade in its holder and said other side of the web; and (d) pressing the excess coating material out laterally in said dam below the top level thereof.

This invention also provides an apparatus for coating both sides of a moving web, such as a paper web, with the same coating material, in which the web is moved in a downward direction between a rotating support roller and a coating blade, directed against the roller, the improvement consisting in a support roller rotating with the web, a first supply means for coating material arranged above a horizontal line (C—C) through said roller centre, and a coating blade and holder arranged just below said horizontal line (C—C), said blade and holder together with the side of the paper web remote from said roller surface forms a space for a dam of coating material.

Other features of the invention will be apparent from the details given in the accompanying claims.

Figure 2:
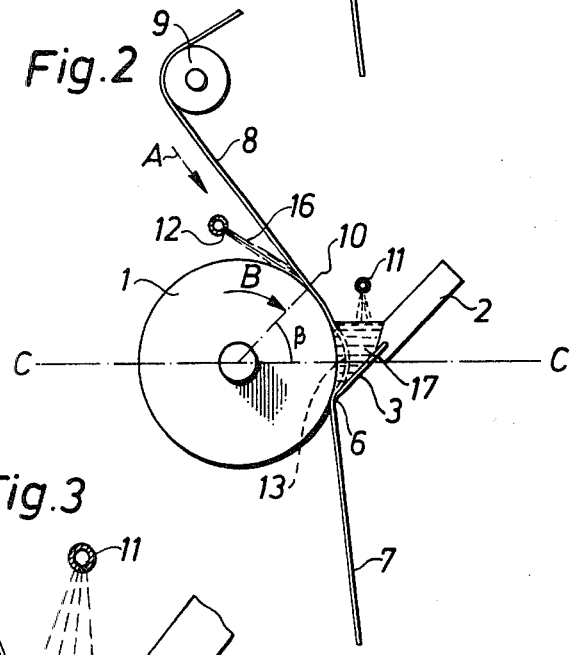
Figure 3:
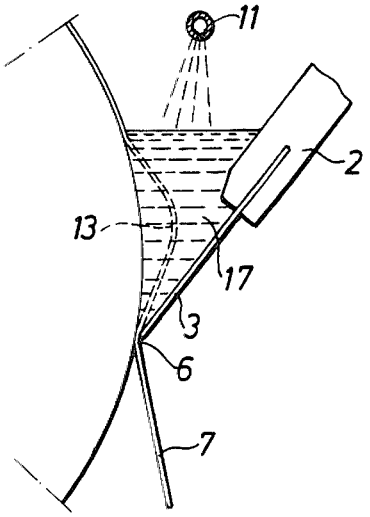

In order that the invention will be more fully understood the following description is given merely by way of example, reference being made to the accompanying drawings, in which FIG. 1 is a schematic end view of a known apparatus, a so called BILLBLADE ® device;

FIG. 2 is a schematic view showing the principle of the method according to the present invention, and FIG. 3 is an enlarged portion of a detail of FIG. 2.

In the known BILLBLADE method shown in FIG. 1, a paper web 4 is fed substantially vertically downwards—in the direction of the arrow A—into a dam of coating material formed between a support roller 1 rotating in the direction of arrow B, and a blade 3 with an associated blade holder 2. The point of contact between the tip of the blade and the paper web and the surface of the roll is denoted 5. It is often preferred that this point should be situated somewhat below a horizontal line C—C through the center of the roller. The angle $\alpha$ between the radius from the roll center to the contact point 5 in relation to the horizontal line C—C through the roll center is about 10°-15°. In this known method, therefore, two sub-dams 14 and 15 respectively are formed one on each side of the web of paper.

FIG. 2 shows an embodiment of an arrangement according to the present invention. The support roller 1 rotates in the direction of arrow B. The blade holder 2 with a blade 3 fixed therein is arranged to press a web of paper 7 against said roller 1. A guide roller 9 is arranged to direct the incoming paper web 8 so that it partially encircles said roller 1—the wrapping angle is designated $\beta$ and constitutes the angle between the roller radius to the point 10 and the horizontal line C—C through the roller center—i e the web 8 meets said roller at a point 10 above said line C—C through the roller center. An excess amount of coating material is in a conventional manner supplied to one side of the blade suitably by means of one or more spray tubes 11, and so that a dam 17 is formed. On the other side of the web, however, the coating material is supplied in excess in the form of a directed stream 16 substantially towards the nip formed between the outer surface of the roller 1 and the part of the paper web which is situated before said tangential point 10. The coating material is advantageously supplied through a tube having one or more slots 12 so that the coating material is injected into this nip at high speed and in a substantially coherent stream.

It has been found that the problems discussed above occurring when using an equipment according to FIG. 1 are completely eliminated by the present invention. Thus it has been found that even a very thin weak paper can be coated on both sides according to the invention without any risk of breakage. Due to the fact that the thin or sensitive paper according to the present invention is made partially to wrap around the roller surface it is supported by said surface and the rotating surface of the roller acts more satisfactorily as a driver and is assisting the feeding of the paper web towards the nip. The stresses arising in the paper web just when it is passing through the nip are thus relieved at a place where of course the friction or braking effect is at a maximum.

It has also been found that the problems in connection with the dam on the roller side also described above are completely eliminated. Since there is no dam above the point where the paper web is brought into contact with the roller, there are no problems associated with disturbance in the dam.

According to the embodiment shown in FIG. 2, it is preferred to use a tube with a longitudinal slot since in that way it is easier to provide a film of coating material which is injected into the nip in substantially coherent form. In this case the coating material is supplied in excess, which means that the coating material is fed by the feed means 12 in excess in relation to the quantity of coating material taken up by the paper on the side facing the roller.

The excess of coating material is expressed laterally first in a position below the top of the dam 17 because the pressure conditions cause the paper web to form a bag-like configuration between the roller 1 and the paper web 7—which is shown in the form of a broken line 13 in FIG. 2. This bag-like configuration is thus defined by a part of the roller surface and a part of the paper web and consequently bag-like openings are formed on each side of the paper web. The excess coating material is pressed out laterally through these openings and is being mixed with the excess also discharged laterally from the dam 17. These two excess amounts of coating material are collected by known means, such as funnel-like means disposed on either side of the two ends of the roller. Since the bag is formed beneath the top of the dam 17, there is largely equal pressure on the inside and outside of said bag and consequently the paper web is not subjected to any appreciable stresses when the surplus on the roller side is pressed out laterally.

It has been found advantageous to vary the wrapping of the paper web 8 around the roll 1 according to different coating conditions. The wrapping angle $\beta$ may advantageously be as much as 30° and, under certain conditions, for example 15°. It has been found, however, that the wrapping angle $\beta$ should not be less than 10°.

The supply means 12 need not necessarily consist of one or more tubes with slots, also other known means may of course be used. The important feature is that they cause the coating material to be projected in a controlled and preferably uniform stream towards the nip between the paper web 8 and the surface of the roller 1. In some cases it may be advantageous to direct the jets somewhat downwards against the roller surface. Otherwise it may be of advantage to direct the stream of coating material somewhat upwards against the paper web.

According to an alternative embodiment of the invention, an excess of coating material can also be applied to the side of the paper web directed towards the roll, whereby the coating material is applied in excess to the roller surface before the contact point 10 between the web 8 and the roller surface. This can advantageously be effected by using a form of doctor levelling, whereby a substantially uniform distribution of the applied layer of coating material is also achieved before the coating material meets the web 8 at the contact point 10. In this case too, the excess coating material is pressed out laterally in a position beneath the top level of the dam 17 and probably just in front of the contact point of the blade 3.

It has thus surprisingly been found that the above mentioned problems arising in coating thin and weak paper webs are completely eliminated by the present invention at both low and high web speeds, and that very satisfactory coatings can be obtained.

As an example of application of the present method at very high speeds, sizing can be carried out with a starch solution having a dry substance content of 12%, and a web speed of 1000 meters per minute and more. The surface weight of the paper has been as low as 40 g/m$^2$ and the paper has been practically unsized. The coating result was very satisfactory and the starch was evenly distributed over both sides of the paper. There was not splashing or dripping. At comparative tests in both a conventional sizing press and in a BILLBLADE coater it was found impossible to achieve this high speed without very considerable splashing and interruption problems.

I claim:

1. A method of coating both sides of a moving paper web by feeding the web downwardly through coating material contained in a dam comprising a support roller rotating in the same direction as the web and a cooperating blade directed towards the roller and forming with the latter a nip through which the web passes, one side of the web being partially wrapped around the roller beginning at a location above the surface of the coating material in the dam, characterized in that an excess of coating material is introduced between the roller and said one side of the web at about the location where the web begins to wrap around the roller such that on passage of the web through said nip the excess coating material thus introduced causes a portion of the web to bulge outwardly from the roller in the dam and below the surface of the coating material contained therein and the excess of coating material to be discharged laterally into the dam at locations below the surface of the coating material contained therein.

2. A method according to claim 1 wherein the excess of coating material is fed to the side of the paper web facing the roller in the form of a directed stream, substantially in a nip formed between the outer surface of the roller and the part of the web which is situated in front of and close to the point of contact between the web and said roller as the former begins to wrap around the latter.

3. A method according to claim 1 wherein the excess of coating material is applied to the side of the web facing the roller by applying the coating material to the roller surface close to and before the point of contact between the web and the roller as the former begins to wrap around the latter.

4. A method according to claim 3, wherein the coating material is applied to the roller surface by doctor means.

5. A method according to claim 2, wherein the directed stream of coating material is injected into the nip as a substantially uniform stream and at relatively high speed.

6. A method according to claim 2 or claim 5, wherein the coating material stream is supplied at approximately the same speed as the web.

7. A method according to claim 6 wherein the web wrapping angle between the radius of the roller to the point of contact where the web begins to wrap around the roller and a horizontal line through the roller center is at least 10%.

8. An apparatus for coating both sides of a web with coating material comprising a rotatable roller and an angularly disposed coating blade disposed in proximity to the surface of the roller to form therewith a dam for containing coating material and a nip at the lower end of the dam, means for running a web to be coated through said dam and nip with one side partially wrapped around said roller beginning at a location above the surface of the coating material in the dam, and means for introducing an excess of coating material between said roller and the adjacent side of the web at about the location where the web begins to wrap around said roller.

9. Apparatus according to claim 8 in which the coating material introducing means comprises a slotted tubular member extending axially of the roller and disposed to discharge coating material uniformly between the roller and the web.

10. Apparatus according to claim 8 in which the coating material introducing means comprises doctor means for applying an excess of coating material to the roller.

* * * * *